US007305802B1

(12) United States Patent
Plavidal

(10) Patent No.: US 7,305,802 B1
(45) Date of Patent: Dec. 11, 2007

(54) FLOOR SQUEAK ELIMINATOR AND FLOOR JOIST STIFFENING APPARATUS

(76) Inventor: Richard W. Plavidal, 11743 County Road 1, Ridgway, CO (US) 81432

( * ) Notice: Subject to any disclaimer, the term of this patent is extended or adjusted under 35 U.S.C. 154(b) by 176 days.

(21) Appl. No.: 11/033,239

(22) Filed: Jan. 10, 2005

Related U.S. Application Data

(60) Provisional application No. 60/535,729, filed on Jan. 8, 2004.

(51) Int. Cl.
*E04G 23/00* (2006.01)

(52) U.S. Cl. ..... 52/291; 52/483.1; 52/223.14; 52/223.8

(58) Field of Classification Search ..... 52/291, 52/483.1, 511, 696, 223.14, 721.3, 223.8, 52/573.1; 248/317, 343
See application file for complete search history.

(56) References Cited

U.S. PATENT DOCUMENTS

| | | | | | |
|---|---|---|---|---|---|
| 1,106,844 | A | * | 8/1914 | Ream | 52/695 |
| 1,106,845 | A | * | 8/1914 | Ream | 52/695 |
| 1,523,711 | A | * | 1/1925 | Powell | 52/695 |
| 1,656,741 | A | * | 1/1928 | Lane | 52/695 |
| 1,685,729 | A | * | 9/1928 | Stone | 52/695 |
| 1,758,934 | A | * | 5/1930 | Conrath | 248/304 |
| 1,934,708 | A | * | 11/1933 | Hatch | 52/695 |
| 2,181,702 | A | * | 11/1939 | Masoner | 52/645 |
| 2,786,242 | A | * | 3/1957 | Stephens | 52/291 |
| 2,865,059 | A | | 12/1958 | Scriven | |
| 4,888,926 | A | * | 12/1989 | Lutz, III | 52/291 |
| 5,105,598 | A | * | 4/1992 | Wilcox | 52/739.1 |
| 5,179,813 | A | | 1/1993 | Martinsen et al. | |
| 5,254,203 | A | | 10/1993 | Corston | |
| 5,313,749 | A | * | 5/1994 | Conner | 52/223.12 |
| 5,371,992 | A | | 12/1994 | O'Berry | |
| 5,372,466 | A | | 12/1994 | O'Berry | |
| 5,577,357 | A | * | 11/1996 | Civelli | 52/233 |
| 5,577,359 | A | * | 11/1996 | McClanahan | 52/291 |
| 5,671,572 | A | * | 9/1997 | Siller-Franco | 52/223.8 |
| 5,893,253 | A | * | 4/1999 | Lutz, III | 52/695 |
| 5,937,608 | A | * | 8/1999 | Kucirka | 52/695 |
| 6,243,996 | B1 | * | 6/2001 | Oliver et al. | 52/126.1 |
| 6,389,766 | B1 | * | 5/2002 | Jackson | 52/291 |

* cited by examiner

*Primary Examiner*—Robert Canfield
*Assistant Examiner*—Chi Q. Nguyen
(74) *Attorney, Agent, or Firm*—Crossley Patent Law; Mark A. Crossley

(57) ABSTRACT

A floor squeak eliminator and floor joist stiffening apparatus, comprising a longitudinal member for extending along a length of a joist, fasteners for attaching each end of the longitudinal member to the joist, and mechanism for pre-tensioning the longitudinal member, the pre-tensioning perpendicular to a length of the longitudinal member and the joist, whereby the joist is pre-tensioned.

5 Claims, 9 Drawing Sheets

Figure 1D2

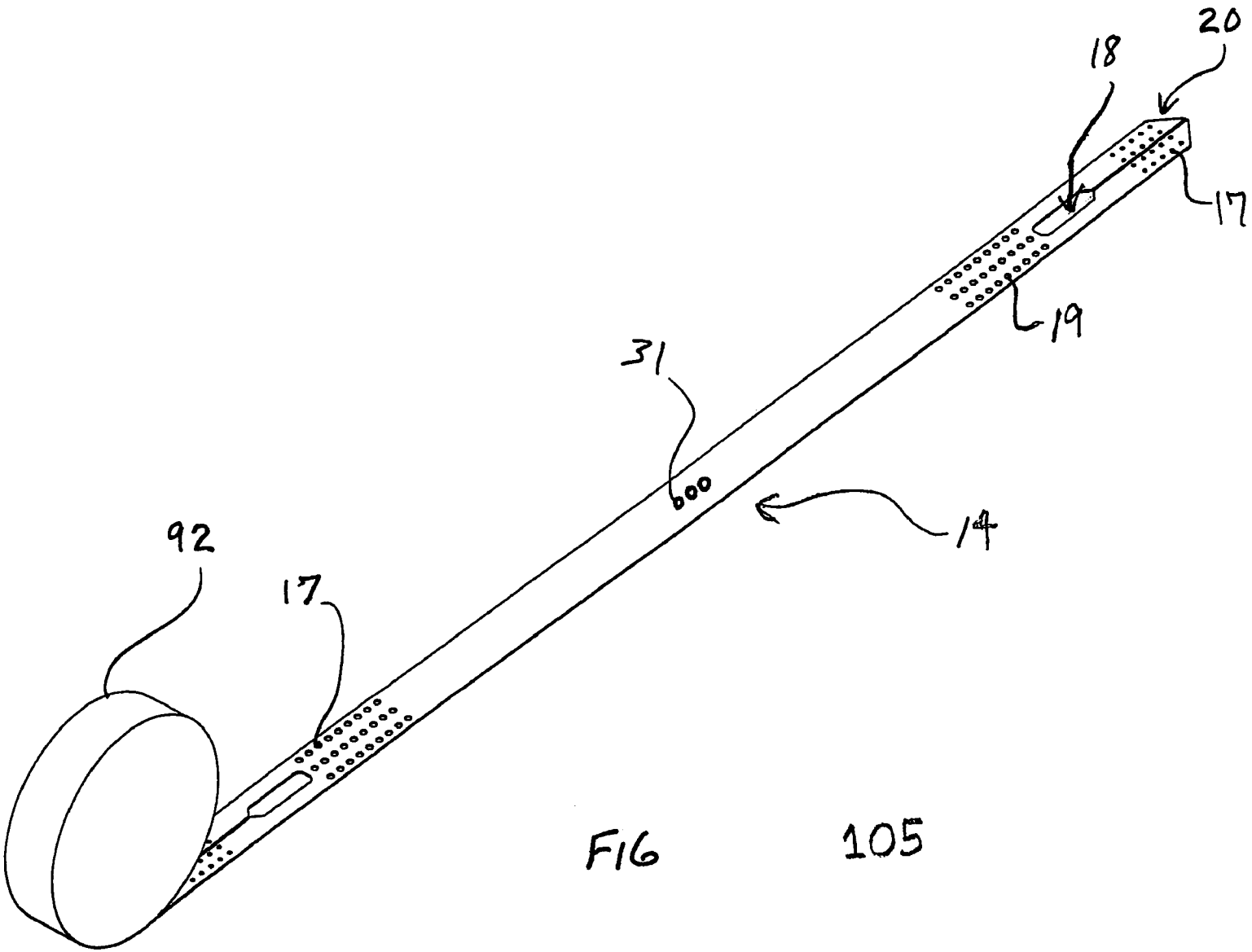
105
FIG

FLOOR SQUEAK ELIMINATOR AND FLOOR JOIST STIFFENING APPARATUS

CROSS-REFERENCE TO RELATED APPLICATIONS

This application claims benefit of 60/535,729 filed on Jan. 8, 2004.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Floor squeaks have long been a problem, with attempted solutions offered to date being more symptom relief approaches, rather than addressing the underlying problem. Flexion of floor joists is typically the problem. Even though joists utilized meet code requirements, they are typically not strong enough to provide quiet and stable floors. Another issue is that existing wiring and plumbing installed through and around floor joists make adding extra joists impossible. Adding more wood to existing joists does not substantially increase joist stiffness and requires not only considerable effort but also the space needed to do so. Further, floor joists typically exist in limited space environments not conducive to additional materials or working freedom. Obstacles such as heating ducts, plumbing, wiring, and the like further hinder joist access. Bonding a floor or sub-floor to the joists below can often prevent squeaks but does nothing to prevent joists flexion. Additionally, bonding floors or sub-floors to the joists below requires invasion of the members. Invasion is especially undesirable or even practically impossible when floor covering is already applied to flooring. What is needed is a floor squeak eliminator and floor joist stiffening apparatus that is compact, lightweight and easy to install, with basic pre-tensioning capability for increasing the stiffness of a joist, thereby preventing joist flexion and floor movement. Further, the apparatus should rely on stiffening each joist individually, and not require the recruitment of surrounding joists or structures.

FIELD OF THE INVENTION

The invention relates to strengthening joists and eliminating joist and floor sags and squeaks, and more particularly to a floor squeak eliminator and floor joist stiffening apparatus that attaches to a floor joist.

DESCRIPTION OF THE PRIOR ART

Prior art attempts to eliminate floor squeaks and to fortify floor joists consist basically of familiar, expected and obvious structural configurations. Further, most devices are either complex or require undesirable invasion of existing floor or sub-floor, as well of requiring too much space for their application. And, the packaging and sale of prior art devices are often prohibitive due to the varying dimensions and materials needed.

Further problems exist wherein prior art attempts require structurally tying joists together such that no squeak elimination or stiffening can occur without structurally joining a plurality of joists. Even then, the joist strength is not increased. By way of example:

U.S. Pat. No. 5,893,253 issued to Lutz, III on Apr. 13, 1999 discloses a floor plate assembly which is configured to be fastened to the underside of an existing floor between adjacent joists. Not only does the device require invasion of an existing floor, it also laterally braces one joist against the next. Force application on the floor above applies lateral force to the lower area of the two joists below. These joists are not designed to bear such lateral force. Additional devices must therefore be installed on the accompanying joists, and so on, so that the forces are continually blockaded from lateral propagation. The current invention is without these design and application flaws. The current invention strengthens a joist independently of all others and does not invade any accompanying structures or related floor members.

U.S. Pat. No. 2,865,059 issued to Scriven on Apr. 13, 1956 discloses a metal joist bridging to be used for bracing floor and ceiling joists. The inherent flaws are like those of U.S. Pat. No. 5,893,253 in that joists are continually braced one against the other. The device does not offer a method for strengthening joists or for individually strengthening joists, especially with respect to vertical load bearing capability.

U.S. Pat. No. 5,372,466 issued to O'Berry on Dec. 13, 1994 discloses a method of eliminating a squeak from a structure subject to foot traffic which drives a screw through a floor into a sub-floor. The method addresses movement between a floor and sub-floor but does not address a lack of strength in a floor joist. The method requires undesirable floor and sub-floor invasion.

U.S. Pat. No. 5,371,992 issued to O'Berry on Dec. 13, 1994 discloses a device for use in the method disclosed in U.S. Pat. No. 5,372,466. The device and method are, again, not capable of strengthening a joist nor preventing its vertical flexion.

U.S. Pat. No. 5,179,813 issued to Martinsen et al. on Jan. 19, 1993 discloses a method and apparatus for repairing squeaky floors. The device and method require invasion of a floor and sub-floor from above, as well as requiring glue. The device and method do not strengthen a floor joist.

U.S. Pat. No. 5,254,203 issued to Corston on Oct. 19, 1993 discloses a method and apparatus for construction of flooring to prevent squeaks. The method and apparatus bonds floor decking to the joists below, during the construction phase. The approach does not strengthen floor joists, nor can it be applied after construction.

While the above-described devices fulfill their respective and particular objects and requirements, they do not describe a floor joist stiffener that provides for the advantages of the present invention, therefore, a need exists for an improved floor joist stiffener. In this respect, the present invention substantially departs from the conventional concepts and designs of the prior art.

SUMMARY OF THE INVENTION

In view of the foregoing disadvantages inherent in the known types of floor joist stiffeners or floor squeak eliminators now present in the prior art, the floor squeak eliminator and floor joist stiffener overcomes the above-mentioned disadvantages and drawbacks of the prior art. As such, the general purpose of the floor squeak eliminator and floor joist stiffener, described subsequently in greater detail, is to provide a floor squeak eliminator and floor joist stiffener which has all of the advantages of the prior art mentioned heretofore and many novel features that result in an improved floor squeak eliminator and floor joist stiffener which is not anticipated, rendered obvious, suggested, or even implied by the prior art, either alone or in combination thereof.

To accomplish this, the invention utilizes a longitudinal member that is coplanar to and attached to a typical floor joist length, the length having two ends and a midpoint. The longitudinal member is attached at each end to the joist. Tension is applied to the longitudinal member in a direction perpendicular to the joist length and to the length of the horizontal member, thereby pre-tensioning a joist.

Production of the tri-fold strap and the zero-clearance strap embodiment are preferably accomplished by stamping or punching of light gauge metal strip. The metal strip is continuously fed to a stamping machine (not shown) for efficient and economical production. A strap is formed from the strip. The tri-fold strap is comprised of a continuous strip of light gauge metal folded along two longitudinal axes to form the tri-fold strap. The tri-fold strap is further comprised of three folded section of equal thirds of the original width of the strip, thereby forming a strap center with two equal outer strap sections folded over the strap center.

In the preferred embodiment, a tri-fold strap is mounted to a typical floor joist. The tri-fold strap comprises the longitudinal. A tri-fold section of the tri-fold strap is positioned below and coplanar to the length of the joist. Mounting plates comprise opposite ends of strap and are secured to opposite ends of the length of joist. Mounting plates are attached at an angle, with a mounting plate angle substantially parallel to a top edge of joist. Mounting holes provide for attaching the mounting plates to a joist with fasteners such as nails or screws or other appropriate fasteners. Strap cutouts proximal to the ends of the tri-fold strap provide for the division of tri-fold strap into opposing mounting plate halves for either side of the joist. Strap cutouts further comprise rounded corners for additional strength of the straps in cutout areas. A strap angle forms the initial transition of the mounting plates into the tri-fold strap.

Initial areas of tri-fold strap proximal to the cutout are further comprised of a plurality of pre-tensioning bolt receptacles. Pre-tensioning bolt receptacles receive pre-tensioning bolts of the single member pre-tensioning mechanism of the tri-fold strap embodiment of the invention. The top side of tri-fold is abutted by the stress distributor. The stress distributor is topped by washer so that turning the pre-tensioning nut above the washer is aided. The pre-tensioning bolt extends upwardly and is affixed to a u-channel bracket with tab. The u-channel bracket with tab surrounds the bottom edge of a joist with the pre-tensioning bolt perpendicular to both the joist length and to the length of the longitudinal member. Channel mount holes on the u-channel with tab provide for mounting the with tab to a joist by fasteners such as bolts, nails, or screws.

Mounting plates of the tri-fold strap are secured to both sides of the joist. In the preferred embodiment the mounting plates are further comprised of holes for the receipt of nails or screws or the like. A further embodiment features stamped teeth, produced while stamping the tri-fold strap, for hammering into the wood. Stamped teeth are known in the building art and are typical of trusses used in joist and roof construction. A plurality of pre-tensioning bolt receptacles provide for ideally locating the single member pre-tensioning mechanism. The u-channel with tab is secured to the bottom side of the joist by u-channel mount holes of both sides of the u-channel brackets with tabs.

A zero-clearance embodiment of invention is also offered. The pre-tensioning strap, for economical reasons, is preferably not a tri-fold strap but instead a single pre-tensioning strap.

The pre-tensioning strap is fastened toward opposite ends and along the side of the joist. Straps are installed on both sides of the joist such that the joist is not inclined to warp or bend in the horizontal plane. Collar brackets are utilized to receive the straps. Collar brackets are comprised of a joist receptacle perpendicularly joined by bracket uprights on either side of the receptacle. Uprights are exteriorly joined to angle supports. Angle supports provide a surface parallel to the receptacle for the threaded receipt of a collar pre-tensioning bolt. Bolts are parallel to the uprights. Below the angle supports, bolts are further comprised of swivels that attach to the strap receptacle. Swivels allow the strap receptacles to freely engage the straps while collar pre-tensioning bolts are turned. Collar brackets are positioned against a lower edge of the joist with joist receptacles receiving the lower edge of the joist. Collar brackets are positioned proximal to opposite mounting plates of the invention. Mounting plates are attached at opposite ends to the sides of the joist. Plates then bend at a strap angle before passing under the strap receptacles. Collar pre-tensioning bolts are tightened to tension the straps. An additional and shorter strap is electively positioned in the center of the joist between longer strap's mounting plates. An additional collar bracket is positioned to receive the approximate center of shorter strap. The longer strap also passes through the center positioned collar bracket. The center collar bracket thereby provides further pre-tensioning of the joist when the joist is of considerable length.

The zero-clearance embodiment of the invention provides for pre-tensioning of a joist when extraneous objects and obstacles are encountered which prevent the installation of the tri-fold embodiment of invention. Obstacles might include air ducts, heating units, wiring, plumbing, clearance problems, or the like.

An additional embodiment of the invention utilizes a cable as the longitudinal member which is attached to a joist. The cable is further comprised of two opposite cable halves centrally joined by a turnbuckle. The cable is centrally attached to either side of the typical turnbuckle by turnbuckle eye bolts. Holes are drilled into the joist for attachment of the cable via cable retention bolts or other appropriate fasteners (not shown). The single member pre-tensioning mechanism differs from that previously utilized in the tri-fold strap embodiment in that the pre-tensioning bolt is replaced by a pre-tensioning upright. The upright is also affixed to a u-channel bracket with tab. The u-channel bracket with tab is mounted identically to previously detailed u-channel bracket. The lower end of upright is affixed with a beveled cable retainer. The beveled retainer provides for stress distribution across the cable. The retainer is preferably grooved or concave for receipt of the cable. The cable is looped around and attached back to itself via cable clamps, at outer ends of the cable. The resultant loop formed is received by bolts for attachment to the sides of the joist. Loops identically formed centrally join the cable halves to the turnbuckle eye bolts. Turning the turnbuckle alternately loosens or tightens the cable, tightening thereby pre-tensioning the joist.

Still a further embodiment of the invention utilizes a channel iron beam as a longitudinal member. The channel iron beam is sized to fit a typical joist such that the beam receives the lower edge of the joist. The upper ends of anchor straps are positioned above opposite ends of the beam. Straps surround the outer surface of the ends of beams. Bolts are inserted through holes in the upper anchor ends and through the joist, thereby holding the channel beam against the lower edge of the joist. A pre-tensioning bolt is tightened through a bottom of the beam and against the bottom edge of the joist to pre-tension the joist. Additional pre-tensioning bolts are utilized when needed.

With each of the embodiments of the floor squeak eliminator and floor joist stiffener, excepting the channel beam embodiment, a flat package is preferred in retail offering, with the invention temporarily bent or coiled, as the embodiment calls for, for reduced package size. The invention is preferably on a flat panel or cardboard or the like, with plastic see-through covering lending visibility to the contents.

The floor squeak eliminator and joist stiffener provides for pre-tensioning and pre-tensioning a joist, stiffening the joist against movement, thereby making a more solid joist and one which prevents floors above from movement and hence squeaking. The invention does so without invading floors or sub-floors. The invention also stiffens joists without having to rely on other accompanying or nearby joists or other components for bracing. The invention requires the recruitment of no other surrounding structures or joists. The invention, in the various embodiments, can be used in virtually any environment, no matter space limitations.

Pre-tensioning of the longitudinal member of the invention offers these advantages and more. Further, the invention is readily installed by amateur and professional alike and with only the most basic of tools. The pre-tensioning nuts are also offered in wing nut designs to further reduce the need for additional tools. Wing nuts provide for the joist unit to be pre-tensioned, or stiffened, by hand. Pre-tensioning is key to a stiff unit.

Thus has been broadly outlined the more important features of the floor joist stiffener so that the detailed description thereof that follows may be better understood and in order that the present contribution to the art may be better appreciated.

Numerous objects, features and advantages of the floor joist stiffener will be readily apparent to those of ordinary skill in the art upon reading the following detailed description of presently preferred, but nonetheless illustrative, embodiments of the floor joist stiffener when taken in conjunction with the accompanying drawings. In this respect, before explaining the current embodiments of the floor joist stiffener in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the joist stiffener. It is therefore important that the claims be regarded as including such equivalent constructions insofar as they do not depart from the spirit and scope of the present invention.

Objects of the floor joist stiffener, along with various novel features that characterize the invention are particularly pointed out in the claims forming a part of this disclosure. For better understanding of the floor joist stiffener, its operating advantages and specific objects attained by its uses, refer to the accompanying drawings and description.

BRIEF DESCRIPTION OF THE DRAWINGS

FIG. 104 is a view of the packaged tri-fold strap embodiment of the invention.

FIG. 105 is a perspective view of the metal roll from which the invention's tri-fold strap is stamped (punched).

FIG. 106 is a top view of the punched tri-fold strap.

DETAILED DESCRIPTION OF THE DRAWINGS

Parts List

Figure 101:
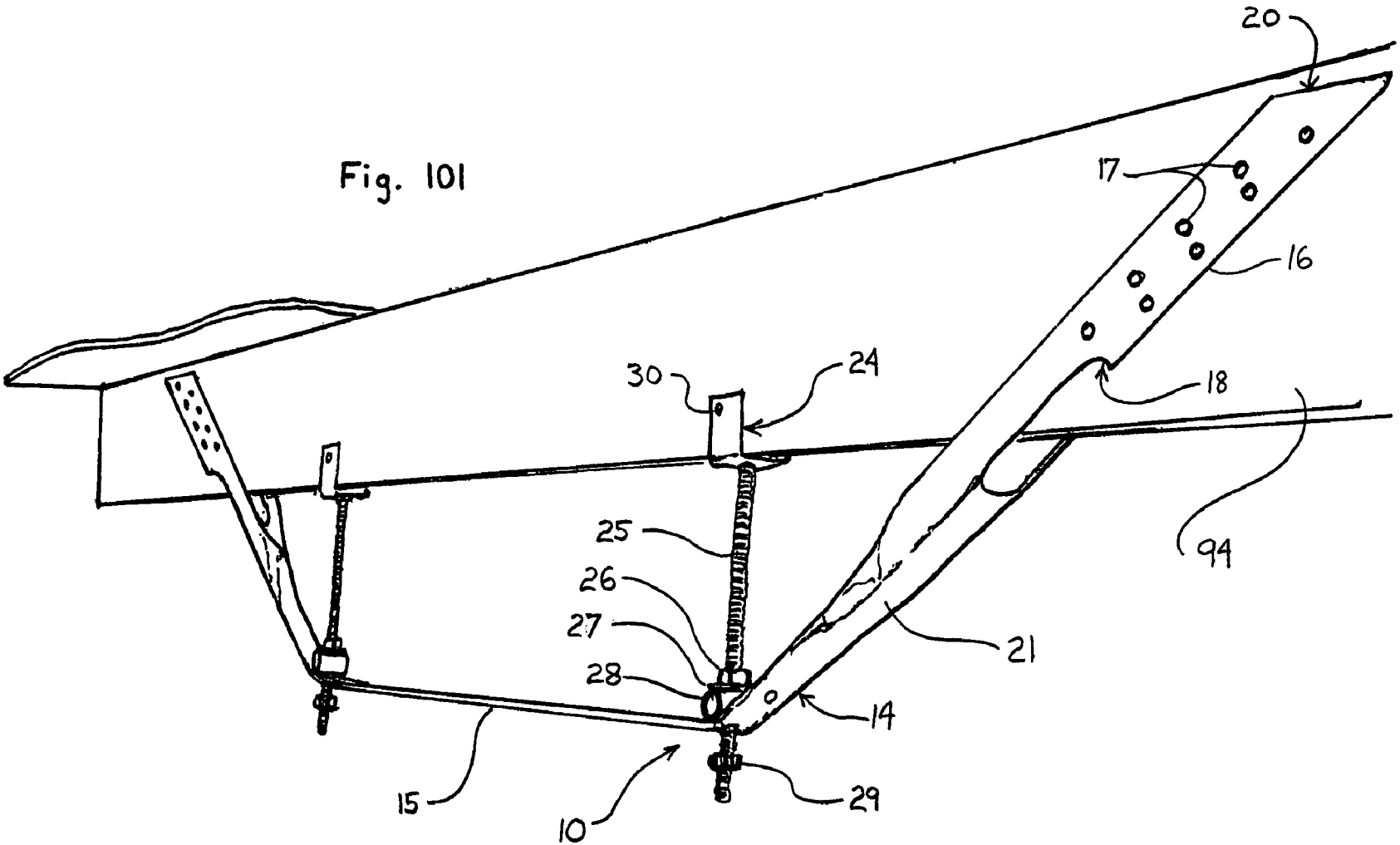
FIG. 101 is a perspective view of the single tri-fold strap embodiment of the invention, installed on a typical joist.

10 the invention
12 longitudinal member
13 strap center
14 tri-fold strap
15 tri-fold
16 mounting plate
17 mounting hole
18 strap cutout
19 pre-tensioning bolt receptacle
20 mounting plate angle
21 strap angle
22 single member pre-tensioning mechanism
24 u-channel bracket
25 pre-tensioning bolt
26 stress distributor
27 washer
28 tensioning nut
29 temporary retaining nut
30 u-channel mount hole
31 additional tensioning bolt hole
32 u-channel bracket tab
40 tensioning strap
42 collar bracket
43 angle support
44 collar pre-tensioning bolt
45 swivel
46 strap receptacle
47 joist receptacle
48 bracket upright
60 cable
62 cable clamp

64 turnbuckle
66 eye bolt
68 cable retention bolt
70 beveled cable retainer
72 pre-tensioning upright
80 channel iron beam
82 pre-tensioning bolt
84 anchor strap
86 strap bolts
88 strap hole
90 package
92 metal roll
94 joist
96 joist hole With reference now to the drawings, and in particular FIGS. 101-111 thereof, the preferred embodiments of the floor joist stiffener employing the principles and concepts of the present invention and generally designated by the reference number 10 will be described.

Figure 102:
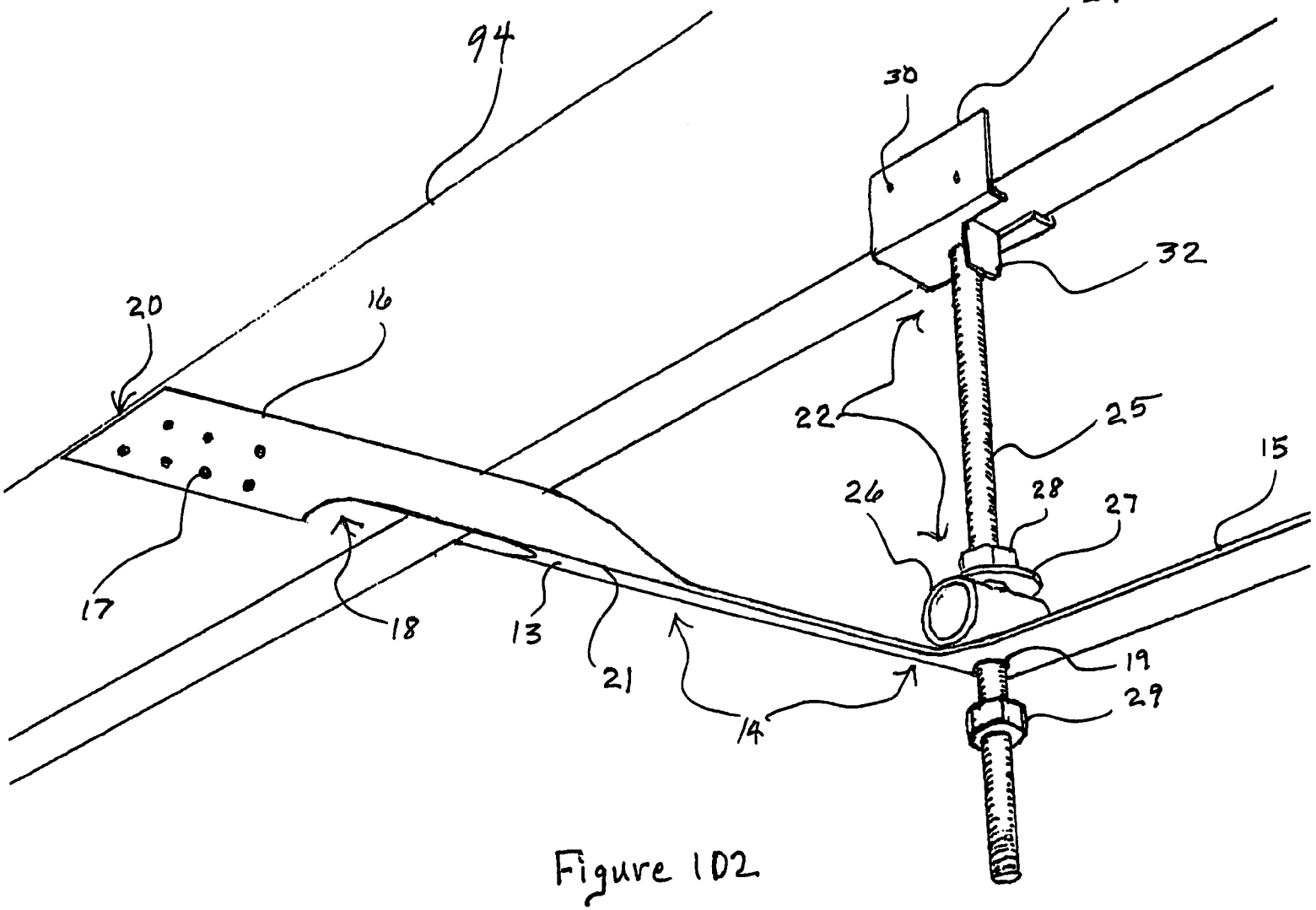
FIG. 102 is a perspective view of the attachment of one end of the invention to a joist.

Referring to FIGS. 101 and 102, the embodiment of the invention 10 utilizing tri-fold strap 14 is mounted to a typical joist 94. Tri-fold strap 14 comprises the longitudinal member 12 of the invention 10. Tri-fold 15 of tri-fold strap 14 is below and coplanar to the length of joist 94. Tri-fold 15 is tensionally held below joist 94 by single member pre-tensioning mechanism 22. Tri-fold 15 is comprised of a continuous strap folded along two longitudinal axes to form tri-fold 15 of equal thirds. Tri-fold 15 is therefore comprised of a strap center 13 with two equal outer strap sections folded over strap center 13. Toward each opposite end, tri-fold 15 transitionally unfolds proximal to strap cutout 18 to form strap angles 21. Outer strap sections transition to form spaced apart mounting plates 16. Strap center 13 terminates in strap cutout 18, whereupon mounting plates 16 are separated and spaced apart for attachment to opposite sides of joist 94. Strap cutout 18 further comprises rounded corners for additional strength of strap 14 in cutout 18 areas. Mounting plates 16 comprise opposite ends of strap 14 and are secured to opposite ends of the length of joist 94 and are attached at an angle, with mounting plate angle 20 substantially parallel to a top edge of joist 94. Mounting holes 17 provide for attaching mounting plates 16 to joist 94 with fasteners such as nails or screws (not shown). Initial areas of tri-fold 15, proximal to cutout 18, are further comprised of a plurality of pre-tensioning bolt receptacles 19. Pre-tensioning bolt receptacles 19 receive pre-tensioning bolts 25 of the single member pre-tensioning mechanism 22. Pre-tensioning bolt 25 passes through tri-fold 14 and extends vertically upward toward joist 94. The top side of tri-fold 15 is abutted by stress distributor 26. Stress distributor 26 is topped by washer 27. Washer 27 is topped by pre-tensioning nut 28. Pre-tensioning bolt 25 extends therefrom vertically upward to u-channel bracket 24 with tab 32. Bolt 25 is perpendicular to the length of joist 94 and length of strap 14. U-channel bracket 24 with tab 32 is further comprised of channel mount holes 30 which provide for mounting u-channel bracket 24 with tab 32 to joist 94 by fasteners such as bolts, nails, or screws (not shown). Temporary retaining nut 29 has been utilized in installation steps of invention 10. Mounting plates 16 of tri-fold strap 14 are secured to both sides of joist 94. A plurality of pre-tensioning bolt receptacles 19 provide for ideally locating single member pre-tensioning mechanism 22. U-channel bracket 24 with tab 32 is secured to the bottom side of joist 94 by u-channel mount holes 30 of both sides of u-channel bracket 24 with tabs 32. Stress distributor 26 is disposed along the lateral end of tri-fold 15 at a point proximal to strap angle 21.

Figure 103:
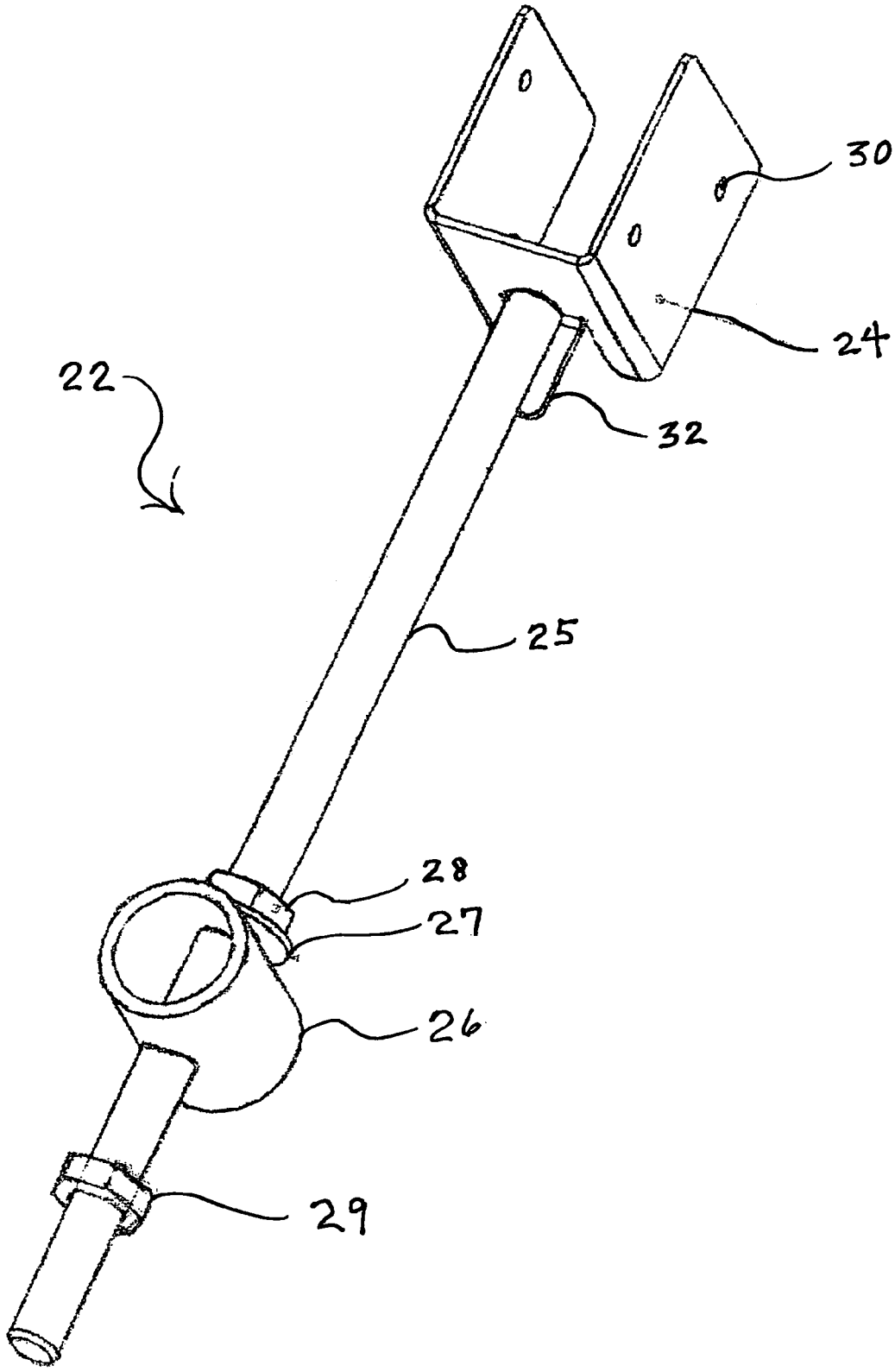
FIG. 103 is a perspective view of the adjustable joist pre-tensioning components of the tri-fold strap embodiment of the invention.
Figure 10A:
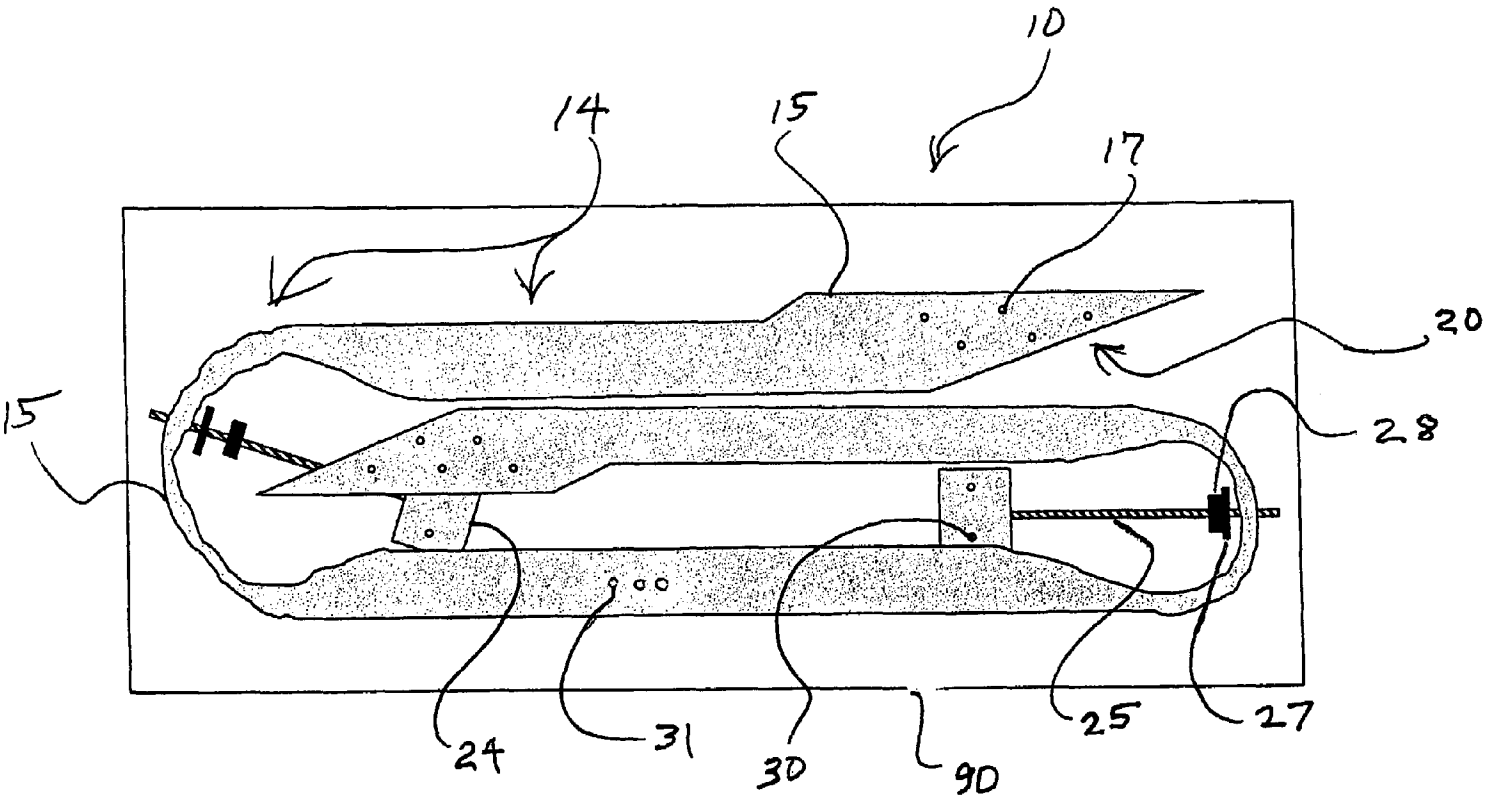
Figure 10B:
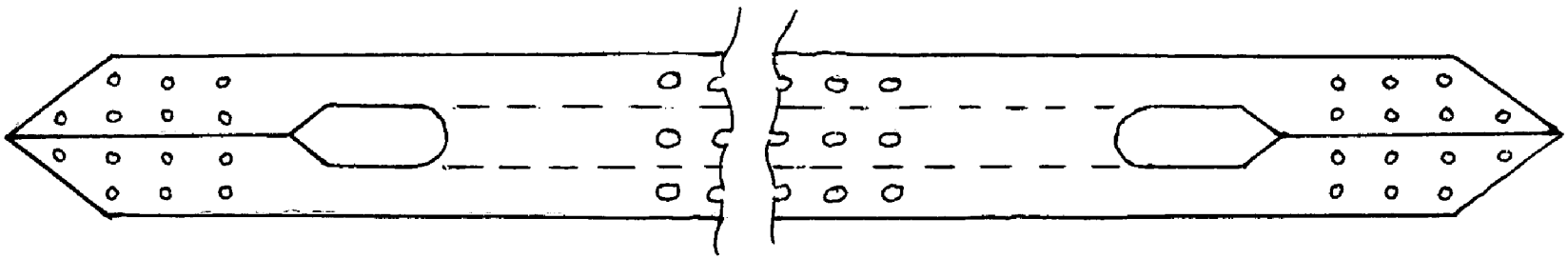

Referring to FIG. 103, the components of single member pre-tensioning mechanism 22 comprise u-channel bracket 24 with tab 32 with u-channel mount holes 30. When in utilized position, pre-tensioning bolt 25 extends from rigid mount to the bottom side of u-channel bracket 24 with tab 32 downward. Pre-tensioning nut 28 abuts washer 27 which abuts stress distributor 26. Stress distributor 26 abuts tri-fold 15 (FIG. 102).

The bottom side of u-channel bracket 24 with tab 32 further comprises tab 32 projecting downwardly along bolt 25. Tab 32 provides additional surface area for attachment of bolt 25.

Referring to FIG. 104, invention 10 is in package 90. Package 90, in preparation of marketing, typically includes plastic wrap covering (not shown). Tri-fold 15 is further comprised of additional pre-tensioning bolt holes 31 which are capable of receiving additional tensional bolts 25 in a given installation (not shown) which electively calls for additional support of invention 10.

Referring to FIG. 105, production of tri-fold strap 14 is stamping (punching) of unrolled metal roll 92, such that roll 92 is continuously fed to a stamping machine (not shown) for efficient and economical production.

Referring to FIG. 106, a stamping of tri-fold strap 14 comprises the various features previously detailed.

Installation of tri-fold embodiment of invention 10 is accomplished via steps. Measurement of joist 94 is typically taken to locate invention 10 approximately centrally along joist 94. Mounting plates 16 and u-channel brackets 24 with tabs 32 are typically tacked into position. Temporary retaining nuts 29 on pre-tensioning bolt 25 prevents tri-fold 15, stress distributor 26, and washer 27 from falling from tri-fold 14. Pre-tensioning nut 28 is backed off toward u-channel bracket 24 with tab 32 such that slack is provided with respect to tri-fold 15. Plates 16 are positioned as desired along a bottom edge of a joist 94.

Mounting plates 16 are tacked into position. With plates 16 and u-channel brackets 24 with tabs 32 located as desired, final attachment of both plates 16 and u-channel brackets 24 with tabs 32 is afforded. Fasteners previously detailed or other appropriate fasteners are utilized. With temporary retaining nut 29 either backed off or taken off, pre-tensioning nut 28 is then turned toward tri-fold 15. The pre-tensioning of joist 94 is accomplished by the application of pressure against longitudinal member 12, the pressure applied perpendicularly to the length of joist 94 and longitudinal member 12.

Figures 107, 108:
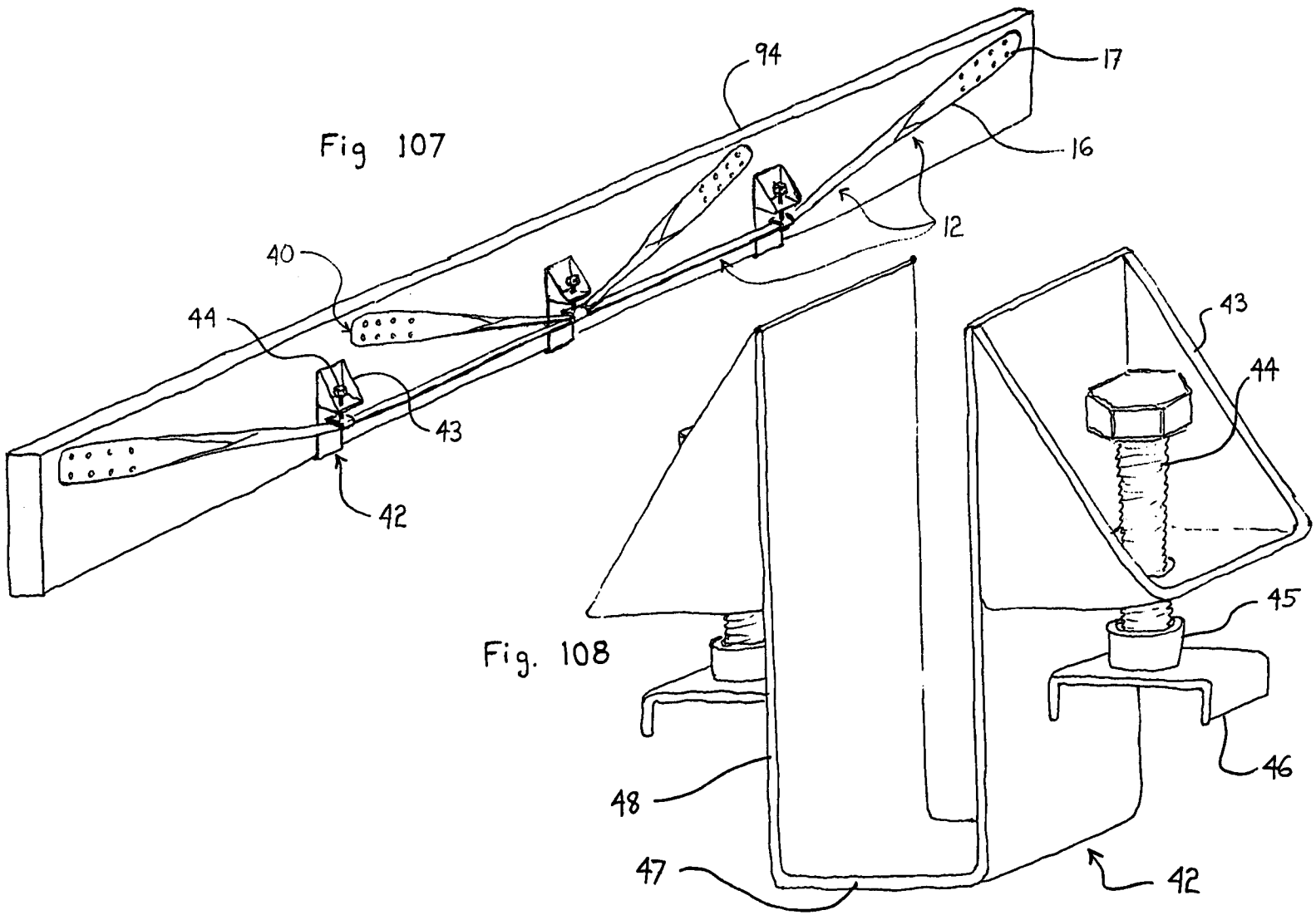
FIG. 107 is a perspective view of the zero-clearance embodiment of the invention installed on one side of a joist, the embodiment further comprising a short strap centered along the joist.
FIG. 108 is a perspective view of the collar bracket utilized in the zero-clearance embodiment of the invention.

Referring to FIGS. 107 and 108, the zero-clearance embodiment of invention 10 is mounted to a joist 94. Pre-tensioning strap 40 is fastened toward opposite ends and along the side of joist 94. Straps 40 are installed on both sides of joist 94 such that joist 94 is not inclined to warp or bend in the horizontal plane. Collar brackets 42 are utilized to receive straps 40. Collar brackets 42 are comprised of joist receptacle 47 perpendicularly joined by bracket uprights 48. Uprights 48 are exteriorly joined to angle supports 43. Supports 43 provide a surface parallel to receptacle 47 for the threaded receipt of collar pre-tensioning bolt 44. Bolt 44 is parallel to uprights 48. Below angle supports 43, bolts 44 are further comprised of swivels 45. Swivels 45 provide for swivel attachment of bolts 44 to strap receptacle 46. Bracket uprights 48 are positioned against a lower edge of joist 94 with joist receptacle 47 receiving the lower edge of joist 94. Collar brackets 48 are positioned proximal to opposite mounting plates 16 of invention 10.

Mounting plates 16 are attached at opposite ends to the sides of joist 94. Plates 16 bend at strap angle 21 before passing under strap receptacles 46.

Collar pre-tensioning bolts 44 are tightened to tension strap 40. An additional and shorter strap 40 is electively positioned in the center of joist 94 between longer strap 40 outer dispositions. An additional collar bracket 42 is positioned to receive the approximate center of shorter strap 40. Longer strap 40 also passes through center positioned collar bracket 42. Center collar bracket 42 thereby provides further pre-tensioning of joist 94 when joist 94 is of considerable length. The zero-clearance embodiment of invention 10 provides for utilization of invention 10 when extraneous objects and obstacles (not shown) are encountered which prevent the installation of the tri-fold embodiment of invention 10.

Figure 109:
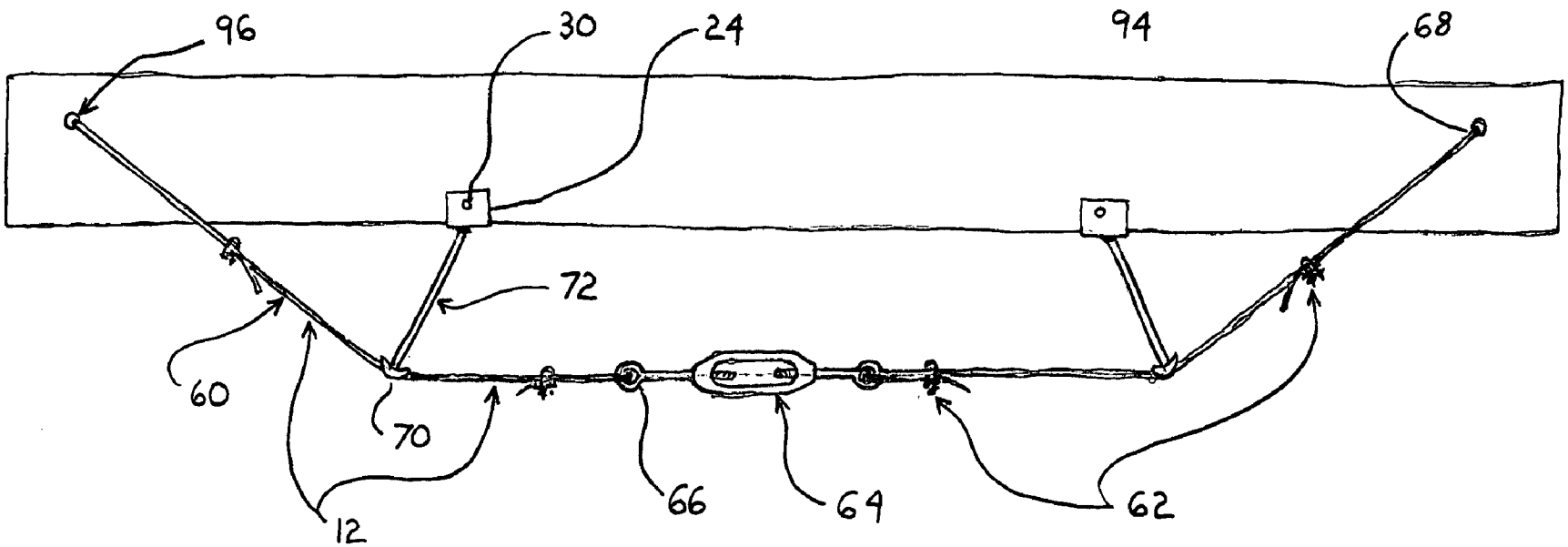
FIG. 109 is a lateral view of the cable embodiment of the invention, installed on a joist.

Referring to FIG. 109, the embodiment of invention 10 utilizes a cable 60 as the longitudinal member 12 which is attached to joist 94. Cable 60 is further comprised of two opposite cable halves centrally joined by turnbuckle 64. Cable 60 is centrally attached to either side of typical turnbuckle 64 by turnbuckle eye bolts 66. Holes 96 are drilled into joist 94 for attachment of cable 60 via cable retention bolts 68 or other appropriate fasteners (not shown). Single member pre-tensioning mechanism 22 differs from that previously utilized in FIGS. 101-106 and FIG. 112 in that pre-tensioning bolt 25 is replaced by pre-tensioning upright 72, which is also affixed to u-channel bracket 24 with tab 32. U-channel bracket 24 with tab 32 is mounted identically to previously detailed u-channel bracket 24 with tab 32. The lower end of upright 72 is affixed with beveled cable retainer 70. Beveled retainer 70 provides for stress distribution across cable 60. Retainer 70 is preferably grooved (not shown) for receipt of cable 60. Cable 60 is looped around and attached back to itself via cable clamps 62, at outer ends of cable 60.

The resultant loop formed is received by bolts 68 for attachment to the sides of joist 94. Identically formed loops centrally join cable halves 60 to turnbuckle 64 eye bolts 66. Turning turnbuckle 64 alternately loosens or tightens cable 60, thus providing for the adjustment of pre-tensioning force applied to joist 94.

Installation of the cable 60 embodiment of invention 10 begins with measurement of a joist 94 such that cable 60 is centrally located. U-channel brackets 24 with tabs 32 are tacked into position to extend their pre-tensioning uprights downward from the lower edge of joist 94. Opposite cable 60 ends are formed proximal to the desired location of bolts 68. Holes are drilled into joist 94 for bolts 68. Cable clamps 62 are positioned for total approximate length of cable 60. Bolts are pushed through the loops of cable 60 ends formed by clamps 62 and cable 60 halves. U-channel brackets 24 with tabs 32 and pre-tensioning uprights are temporarily positioned. Positioning can thereby be altered prior to permanent attachment to joist 94. Permanent attachment is then afforded and executed. Turnbuckle 64 is turned to tighten longitudinal member 12 (cable 60) to pre-tension joist 94.

Figure 110:
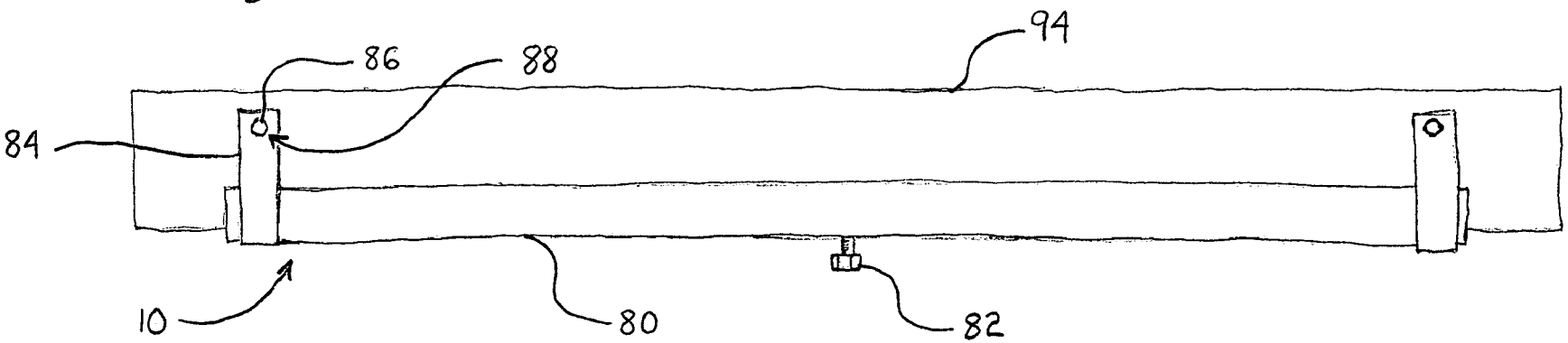
FIG. 110 is a lateral view of the channel iron beam embodiment of the invention, installed on a joist.
Figure 111:
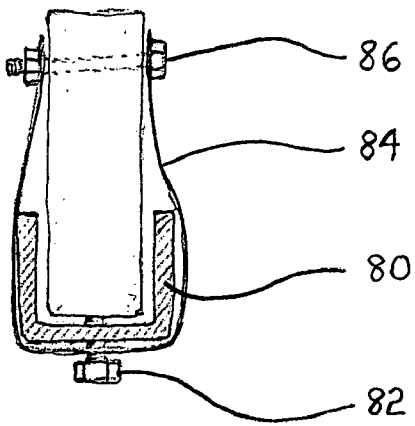
FIG. 111 is an end view of the steel strap and channel iron beam of the channel iron beam embodiment of the invention, installed on a joist.

Referring to FIGS. 110 and 111 of an alternate embodiment of invention 10 utilizes channel iron beam 80 as longitudinal member 12. Channel iron beam 80 is sized to fit typical joist 94 such that beam 80 receives the lower edge of joist 94. Joist 94 is measured to determine the midpoint. The center of beam 80 is positioned approximate to the midpoint of joist 94. Pre-tensioning bolt 82 is backed off from threaded receipt in beam 80. Beam 80 is positioned as chosen. The upper ends of anchor straps 84 are positioned above opposite ends of beam 80.

Straps 84 surround the outer surface of the end of beam 80. Holes are drilled into joist 94 using strap holes 88 of straps 84 as guides. Bolts 86 are inserted through holes 88 and tightened. Pre-tensioning bolt 82 is tightened against the lower edge of the joist 94 to pre-tension joist 94.

With respect to the above description then, it is to be realized that the optimum dimensional relationships for the parts of the floor joist stiffener, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor squeak eliminator and floor joist stiffening apparatus, comprising:

a longitudinal member having opposite ends and a length, the longitudinal member extending along a horizontal length of a floor joist, the longitudinal member further comprising a tri-fold strap, the tri-fold strap further comprising a tri-fold, the tri-fold having a strap center and two outer sections, the strap center terminating in a strap cutout proximal to each end of the tri-fold strap, the outer sections transitioning into spaced apart mounting plates, the mounting plates for fastening on opposite sides of a joist length;

means for attaching each end of the longitudinal member to the joist;

means for adjustably pre-tensioning the longitudinal member wherein the adjustable pre-tensioning means is a single member pre-tensioning mechanism, the mechanism comprised of a u-channel bracket for fitting around a lower edge and sides of the joist, whereby the pre-tensioning force is vertically perpendicular to the length of the longitudinal member and the joist, whereby the joist is pre-tensioned;

a pre-tensioning bolt affixed to the u-channel bracket and extending vertically downwards, the pre-tensioning bolt further comprised of a pre-tensioning nut, a washer, and a stress distributor, respectively, the stress distributor contacting an upper surface of the tri-fold, the tri-fold further comprising at least one pre-tensioning bolt receptacle for receiving the pre-tensioning bolt, the pre-tensioning nut for adjustably pre-tensioning the tri-fold strap, thereby pre-tensioning the joist.

2. The floor squeak eliminator and floor joist stiffening apparatus in claim 1 comprising more than one single member pre-tensioning mechanism.

3. A floor squeak eliminator and floor joist stiffening apparatus, comprising:

a longitudinal member having opposite ends and a length, the longitudinal member extending along a horizontal length of a floor joist;

at least two tensioning straps, the tensioning straps for mounting on opposite sides of the joist wherein each tensioning strap is further comprised of mounting plates at each end;

at least one collar bracket, the collar bracket for mounting to and around the lower edge or the joist, the collar bracket comprised of a joist receptacle perpendicularly joined by bracket uprights, the bracket uprights exteriorly joined to angle supports, the supports further comprising a surface parallel to the joist receptacle, the parallel surface further comprising threaded receipt for a collar pre-tensioning bolt, the pre-tensioning bolt comprising, below the parallel surface, a swivel attachment for the pre-tensioning bolt, the swivel attachment further comprising the strap receptacle for the receipt of the tensioning strap;

means for attaching each end of the longitudinal member to the joist;

means for adjustably pre-tensioning the longitudinal member, whereby the pre-tensioning force is vertically perpendicular to the length of the longitudinal member and the joist, whereby the joist is pre-tensioned.

4. A floor squeak eliminator and floor joist stiffening apparatus, comprising:

a longitudinal member having opposite ends and a length, the longitudinal member extending along a horizontal length of a floor joist, wherein the longitudinal member further comprises a cable comprised of two half cables joined by a turnbuckle, the turnbuckle for pre-tensioning the joist;

means for attaching each end of the longitudinal member to the joist;

means for adjustably pre-tensioning the longitudinal member, whereby the pre-tensioning force is vertically perpendicular to the length of the longitudinal member and the joist, wherein the pre-tensioning means comprises:

at least one pre-tensioning upright, the pre-tensioning upright fixed at an uppermost end with a u-channel bracket, the u-channel bracket for fitting around a lower edge and sides of the joist, the pre-tensioning upright downwardly terminating in a cable retainer, the cable retainer receiving the cable.

5. A floor squeak eliminator and floor joist stiffening apparatus, comprising:

a longitudinal member having opposite ends and a length, the longitudinal member extending along a horizontal length of a floor joist wherein the longitudinal member comprises a channel iron beam, the channel iron beam fitting about a lower edge and sides of the joist and extending horizontally thereon;

anchor straps, the straps fastening around opposite ends of the joist lower edge and sides, the straps receiving and supporting the channel iron beam;

a pre-tensioning bolt threadably received in a center of the channel iron beam, the bolt applying upward pressure against the joist, thereby pre-tensioning the joist;

means for attaching each end of the longitudinal member to the joist;

means for adjustably pre-tensioning the longitudinal member, whereby the pre-tensioning force is vertically perpendicular to the length of the longitudinal member and the joist, whereby the joist is pre-tensioned.

* * * * *